US006809713B2

(12) United States Patent
Peng

(10) Patent No.: US 6,809,713 B2
(45) Date of Patent: Oct. 26, 2004

(54) ALUMINUM-EXTRUDED LCD FRAME

(76) Inventor: Ching-Lung Peng, 1460, Chung Cheng West Road, Chu Pei City, Hsinchu Hsien (TW)

( * ) Notice: Subject to any disclaimer, the term of this patent is extended or adjusted under 35 U.S.C. 154(b) by 264 days.

(21) Appl. No.: 10/083,109

(22) Filed: Feb. 27, 2002

(65) Prior Publication Data

US 2003/0160908 A1 Aug. 28, 2003

(51) Int. Cl.[7] ..... G09G 3/36

(52) U.S. Cl. ..... 345/87; 349/58; 348/825; 40/603

(58) Field of Search ..... 349/58, 187; 348/836, 348/825–831; 40/530; 345/87; 248/900, 948; 362/691–693

(56) References Cited

U.S. PATENT DOCUMENTS 4,674,213 A * 6/1987 Keithley ..... 40/603
6,411,271 B1 * 6/2002 Bang et al. ..... 345/87
6,477,039 B2 * 11/2002 Tajima ..... 361/681
6,654,078 B1 * 11/2003 Kato et al. ..... 349/58

* cited by examiner

*Primary Examiner*—Dennis-Doon Chow
*Assistant Examiner*—Aaron S. Ward
(74) *Attorney, Agent, or Firm*—Troxell Law Office PLLC

(57) ABSTRACT

An aluminum-extruded LCD frame at least comprises an aluminum-extruded front molding, a backing pad, a support, and a plurality of mobile clamps permissible to slide along the rim of the frame for properly adjusting and locking the LCD panel in the frame. This aluminum-extruded LCD frame has specific features in lightweight, environment-friendliness and economics in production. This frame provides the concave rib and convex groove at butt joint as the most effective shield against the electromagnetic wave to minimize the radiation emitted from the LCD panel. In particular, the mobile clamps are designed to slide along a concave track on the backing pad and to hold up the LCD panel in any size within the frame. This universal application profits in honing the competitive edge and ease to promote the sale volume.

5 Claims, 12 Drawing Sheets

ALUMINUM-EXTRUDED LCD FRAME

FIELD OF THE INVENTION

This invention relates to a method for fabricating an LCD frame, particularly an aluminum-extruded LCD frame with low production cost, low radiation, universal application for holding LCD panel in any size and environmental recycling.

BACKGROUND OF THE INVENTION

Nowadays, most LCD frames are resin-intruded products, even though in very low production cost, they often release hazardous chemical compounds in the recycling process, hard to decompose in the landfill and causing many ecological problems in the long run. In the near future, it is apparent that the plastic LCD frame will be forever eliminated for the environmental reason, so the LCD frame industry is facing a critical situation.

Furthermore, to ward off the EMI, it is a general practice to add a metal shield to the plastic LCD frame; in so doing, the advantage of lightweight the plastic LCD frame cherishes is entirely ruined by addition of a heavy weight of the metal shield. The LCD frame industry has been working hard to seek a substitute with light-weighted and environmental-friendly peripheral in an attempt to sharp the competitive edge.

There are two methods to make aluminum Lcd frames, one is casting and another is extruding. For the sake of production cost, the extruding has gradually taken the place of the casting because the casting molds are too expensive, and there is no way for the casting method to form in one shot the vertical concave rib as the ribs 13 and 23 shown in FIG. 11 which are an effective shield to stop EMI. Up to now, the extruding is considered an economical way to produce the LCD frame.

In addition, the most cases, the LCD panel is usually bolted in the LCD frame. Since the fastening position has not been standardized yet, the bolting position varies greatly. What the LCD frame industry does now is to supply one kind of frame specified for a certain LCD panel only. There is no universal application, less to say the competitive. This is really a bottleneck the LCD frame industry has to surmount.

SUMMARY OF THE INVENTION

The major object of the invention is to provide a method for fabricating the aluminum-extruded and diagonally welded LCD frame with advantages of lightweight, environmental recycling, low production cost and high economic benefit.

Another object of the invention is to provide an aluminum-extruded LCD frame with concave rib and convex groove at the butt joint to shield the electromagnetic wave the LCD panel emits and to reduce the radiation to the minimum.

Another object of the invention is to provide an aluminum-extruded LCD frame in which a plurality of mobile clamps are designed to slide along the backing pad, suitable for universally holding the LCD panel in any size in an effort to enhance the sale as well as the competition.

The technical characteristics of the invention are explained in great details with the aid of preferable embodiments as illustrated in the attached drawings.

DETAILED DESCRIPTION OF THE INVENTION

Figure 1:
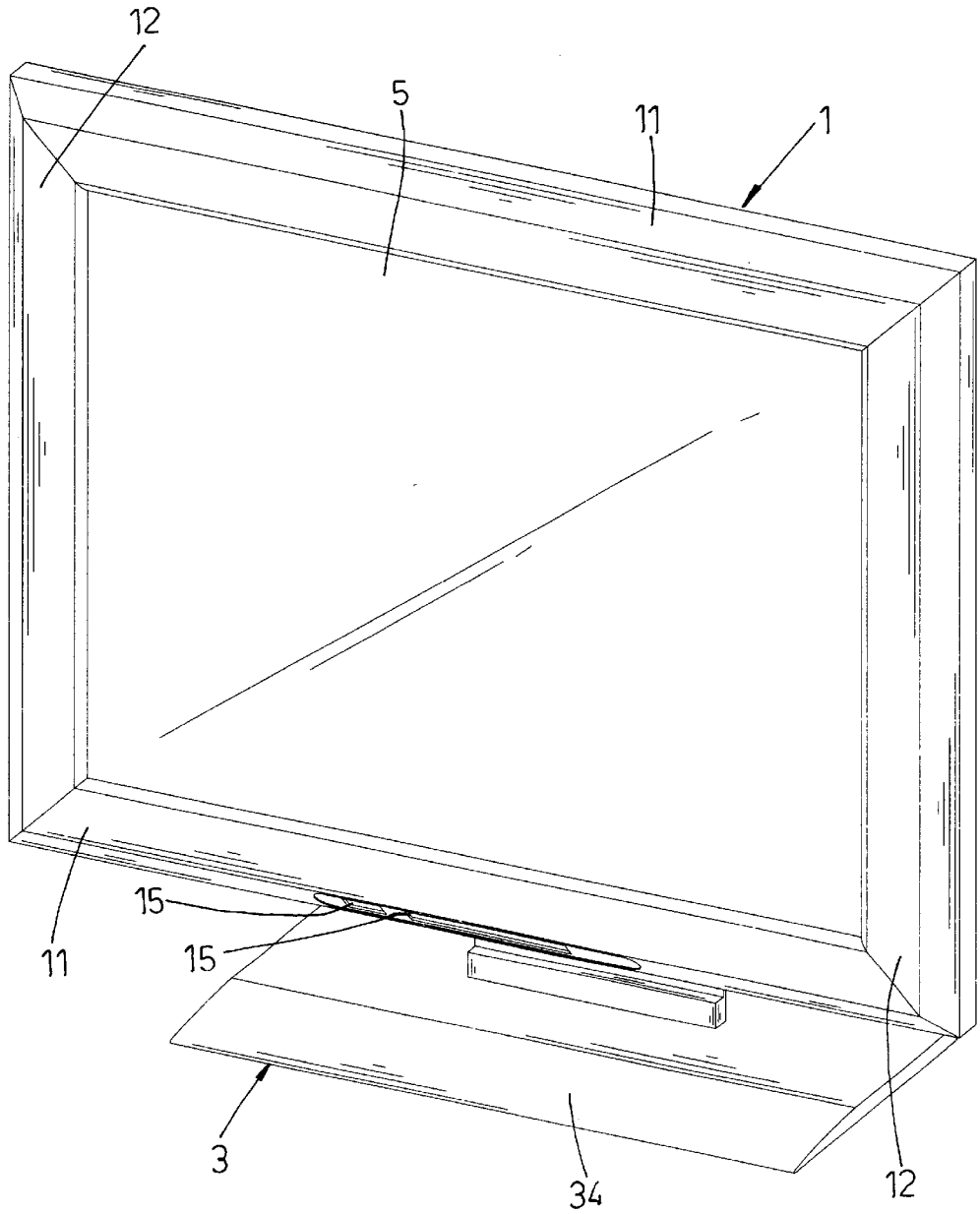
FIG. 1 shows a stereo outlook of the LCD frame of this invention.
Figure 2:
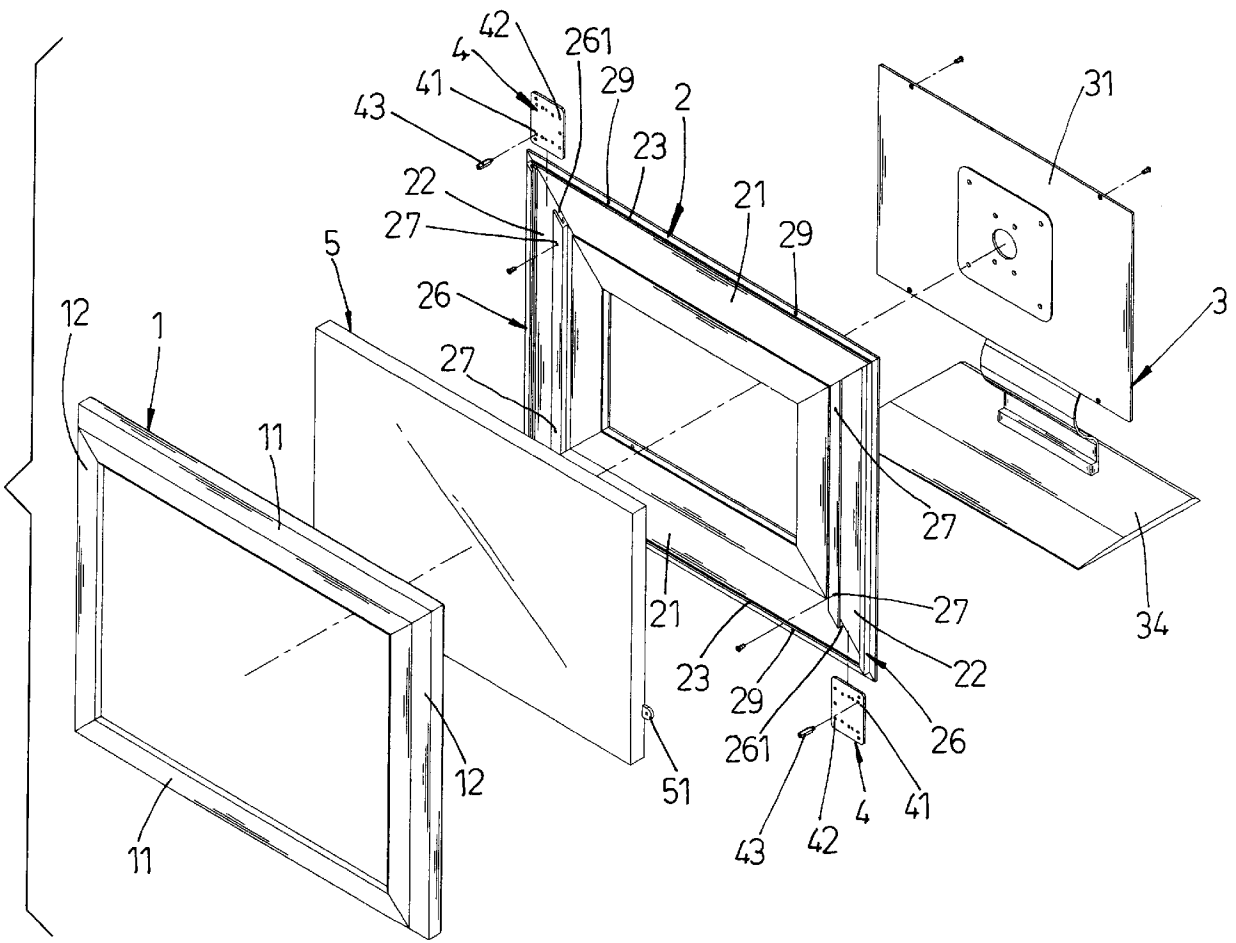
FIG. 2 shows a stereo disassembly of the LCD frame of this invention.

FIGS. 1 and 2 show an aluminum-extruded LCD frame, mainly comprising the front molding 1, the backing pad 2, support elements 3 and a plurality of mobile clamps 4 for adjustment and locking up the LCD panel in place.

Figure 3:
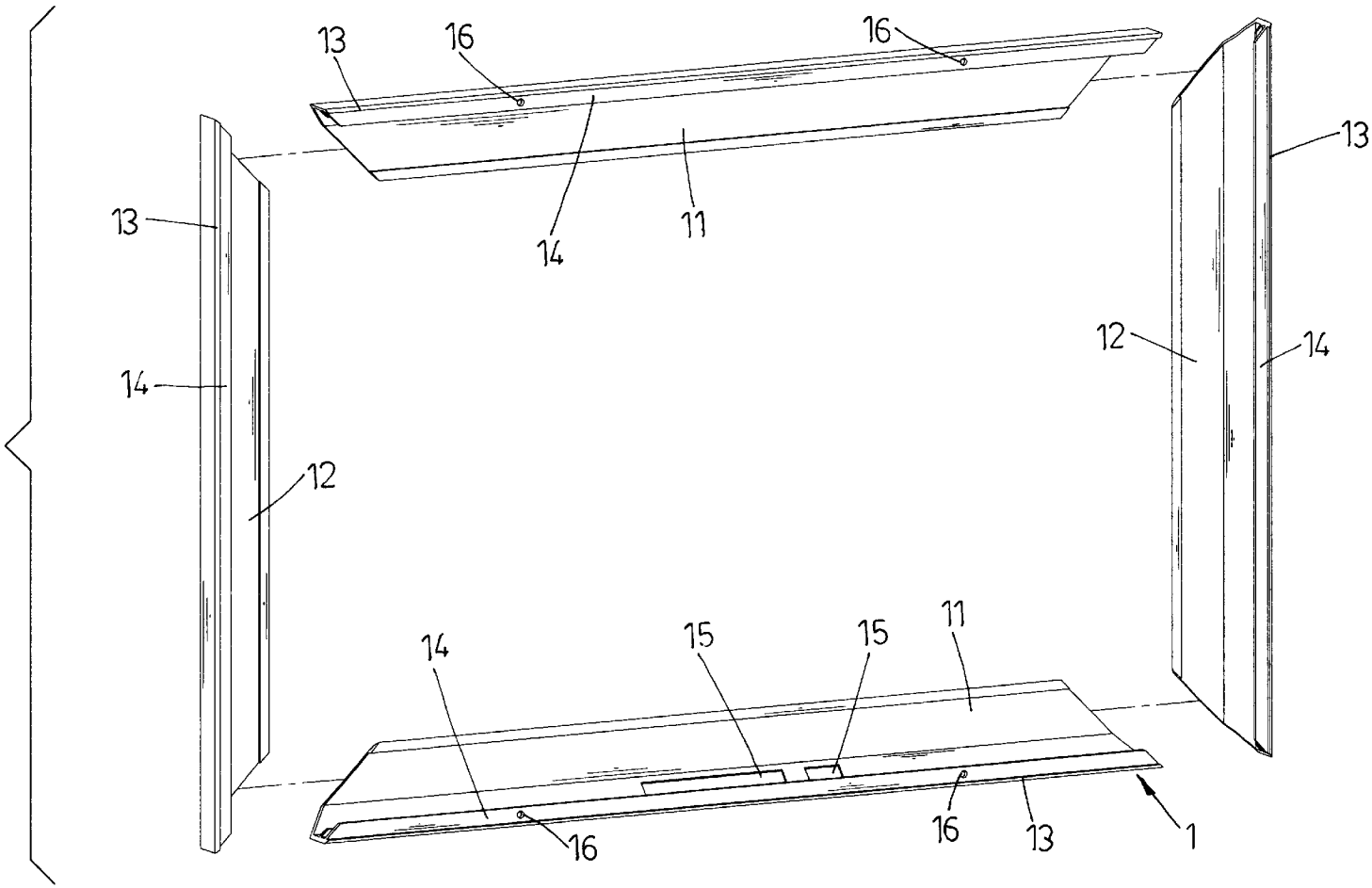
FIG. 3 is a schematic diagram showing the stereo disassembly of the front molding of the LCD frame of this invention.

As shown in FIG. 3, the front molding 1 consists of a long stile 11 and a short stile 12; both ends are cut at a diagonal of 45 degrees and welded together to form an integral front molding. A concave rib 13 and a convex groove 14 are formed in the extrusion process along the rim of the long stile 11 and the short stile 12.

Figure 4:
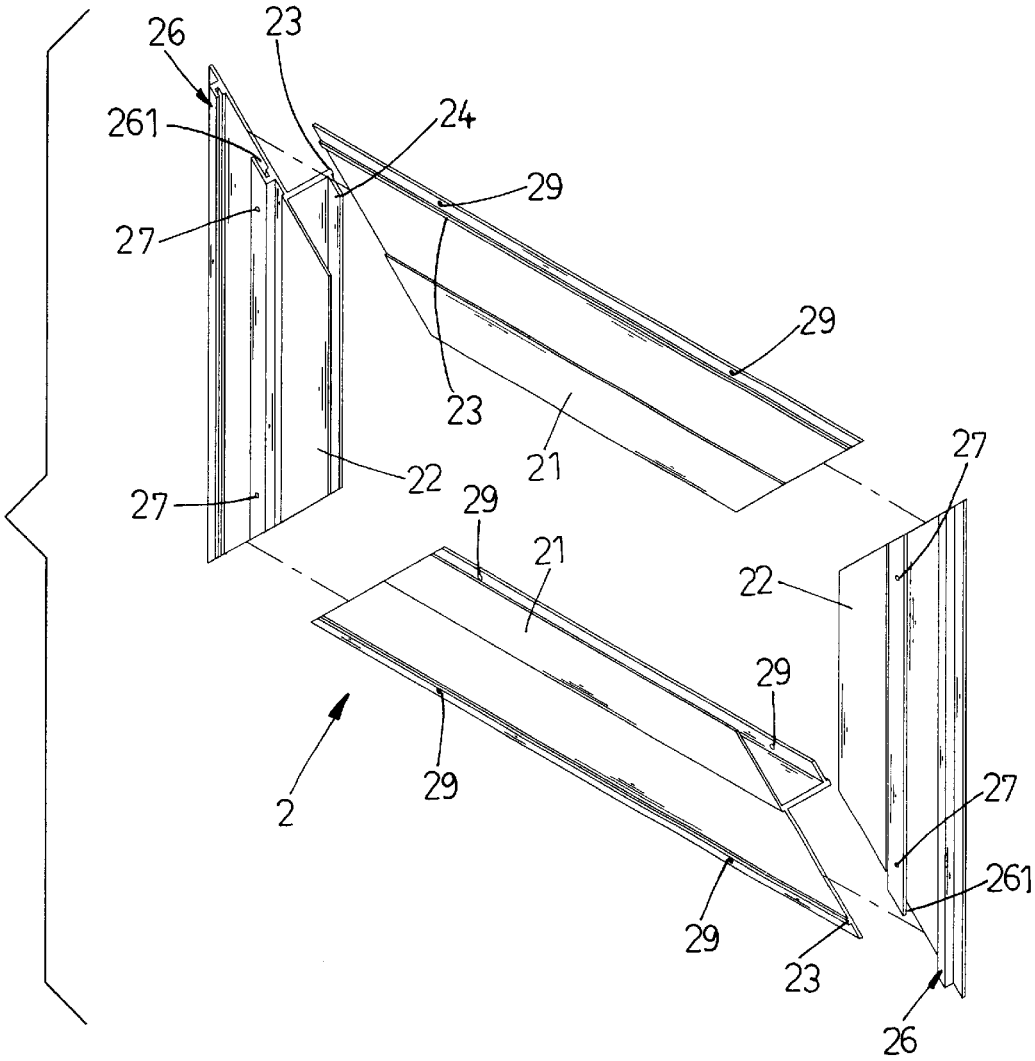
FIG. 4 is a front view of the stereo disassembly of the backing pad of the LCD frame of this invention.
Figure 5:
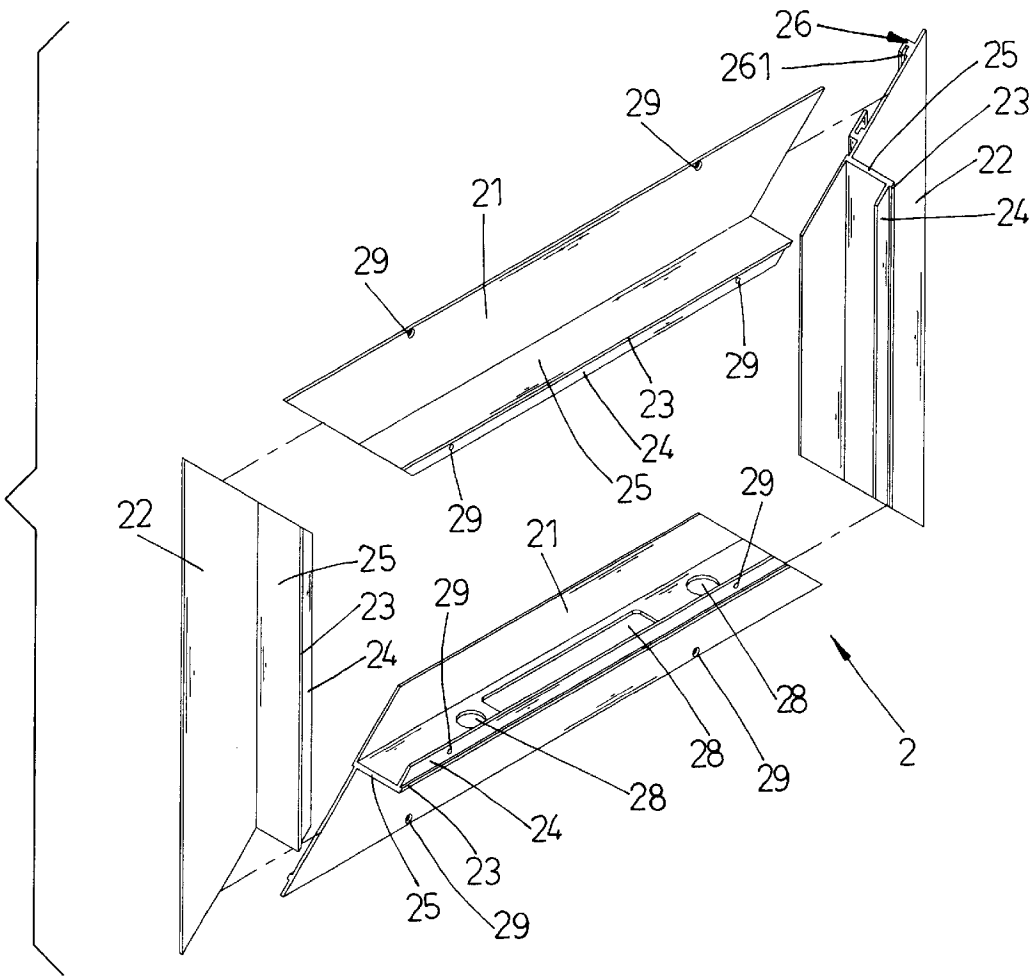
FIG. 5 is a back view of the stereo disassembly of the backing pad of the LCD frame of this invention.

As shown in FIGS. 4 and 5, the backing pd 2 is also composed of a long stile 21 and a short stile 22, cut at a diagonal of 45 degrees and welded together as does the front molding 1. The long stile 21 is extruded with a vertical strip 25, concave rib 23 and convex groove 24. The short stile 22 is extruded with a concave track 26 and a slide slot 261, permitting the mobile clamp 4 to slide within. The retaining holes 27 are drilled directly under the slide slot 261 and near the border of short stile 22.

The said front molding 1 and the backing pad 2 are aluminum extruded products, and welded into a square frame form. After the front molding 1 and the backing pad 2 are formed in shape, they are processed with stamping operation to cut rectangular slots 15 and 28 along the border as shown in FIGS. 3 and 4 for receiving the sockets, indication lamps and power switch externally connected to the LCD panel.

As shown in FIGS. 2 through 6, the transverse concave track 26 on the backing pad 2 permits the mobile clamp 4 to slide on. The mobile clamp 4 is drilled a plurality of bolt holes 41 at a vertical line and bolt holes 42.

The bolt hole 41 will accept a hexagon bolt 43, which passes through the lock lug 51 on the LCD panel 5 so as to lock the LCD panel 5 on the backing pad 2.

Figure 6:
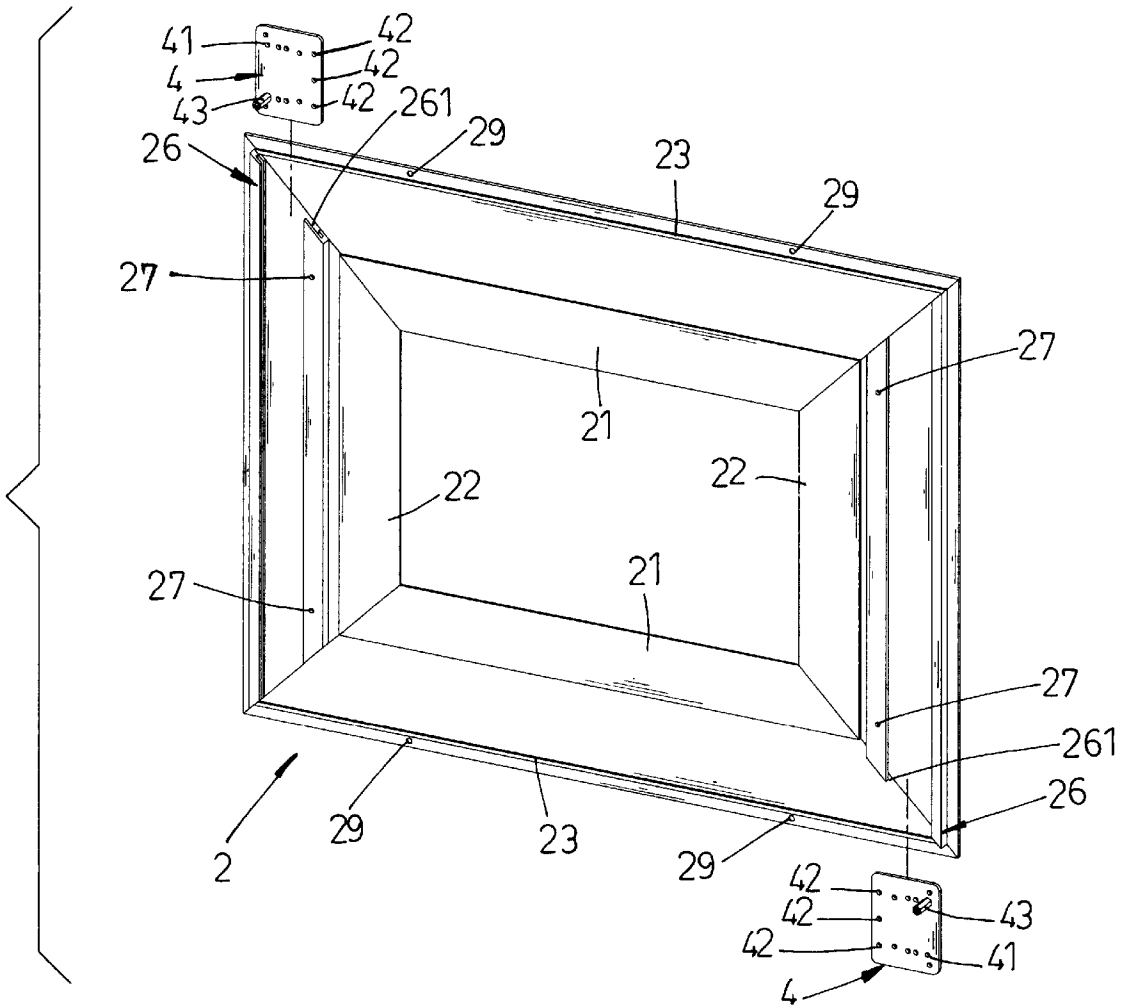
FIG. 6 is a schematic diagram showing the arrangement of mobile clamps with the backing pad of the LCD frame of this invention.

The number and position of the bolt holes 41 and 42 are pre-determined in response to the number and position of the lock lug 51 of the LCD panel 5. Taking 14" to 17" LCD panel as an example, the number and relative position differ greatly. FIG. 6 shows the exact position and number of bolt holes 41 along the transverse concave track 26 of the backing pad 2.

Figure 7:
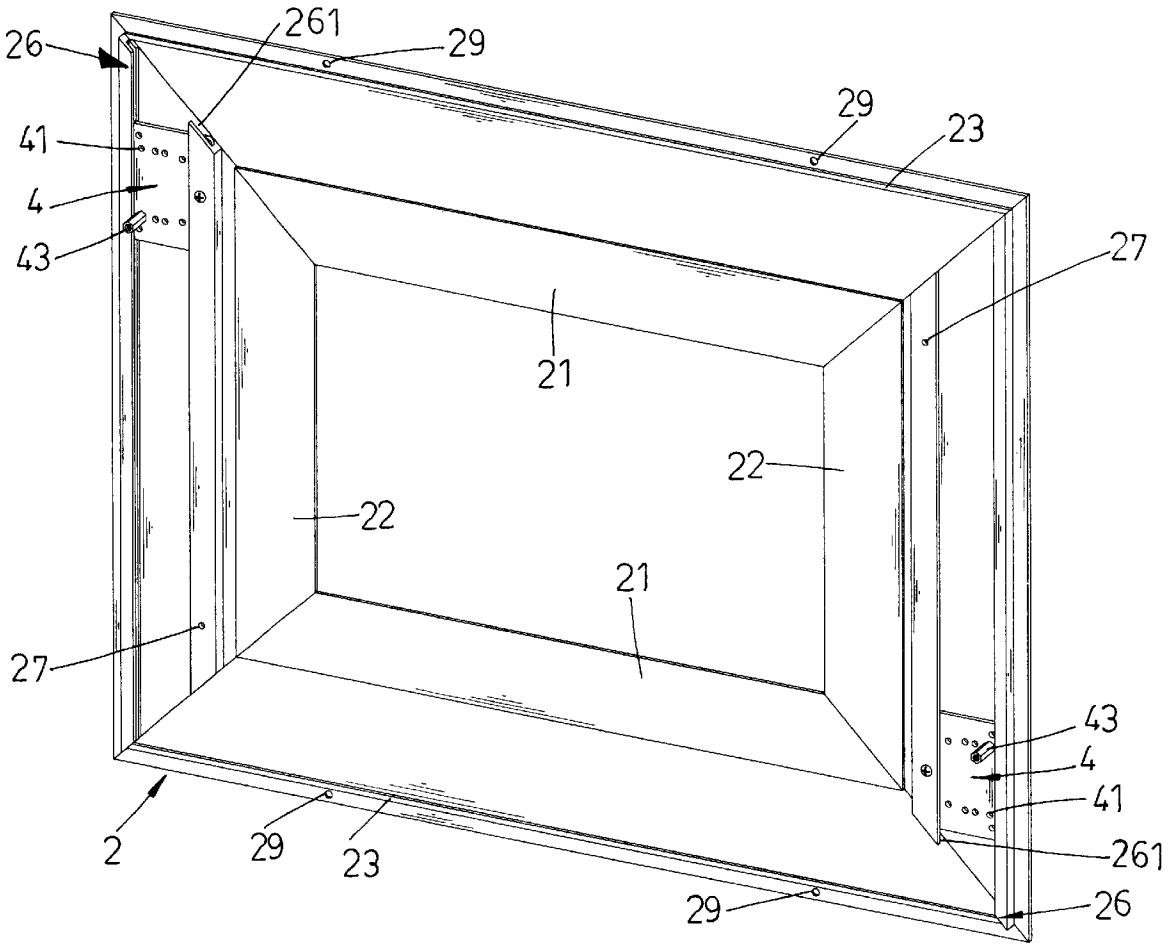
FIG. 7 is a schematic diagram showing the mobile clamps are suitable to lock up the LCD panel in any size.

The position of the bolt holes 42 shall be drilled along the center line of the retaining holes 27 on the concave track 26 of the backing pad 2, so mobile clamp 4 will be locked to the concave track 26 of the backing pad 2 through the bolt hole 42 aligned with the retaining hole 27 as shown in FIG. 7, the numbers of bolt holes 42 are drilled in accordance with the size of LCD panel.

Figure 8:
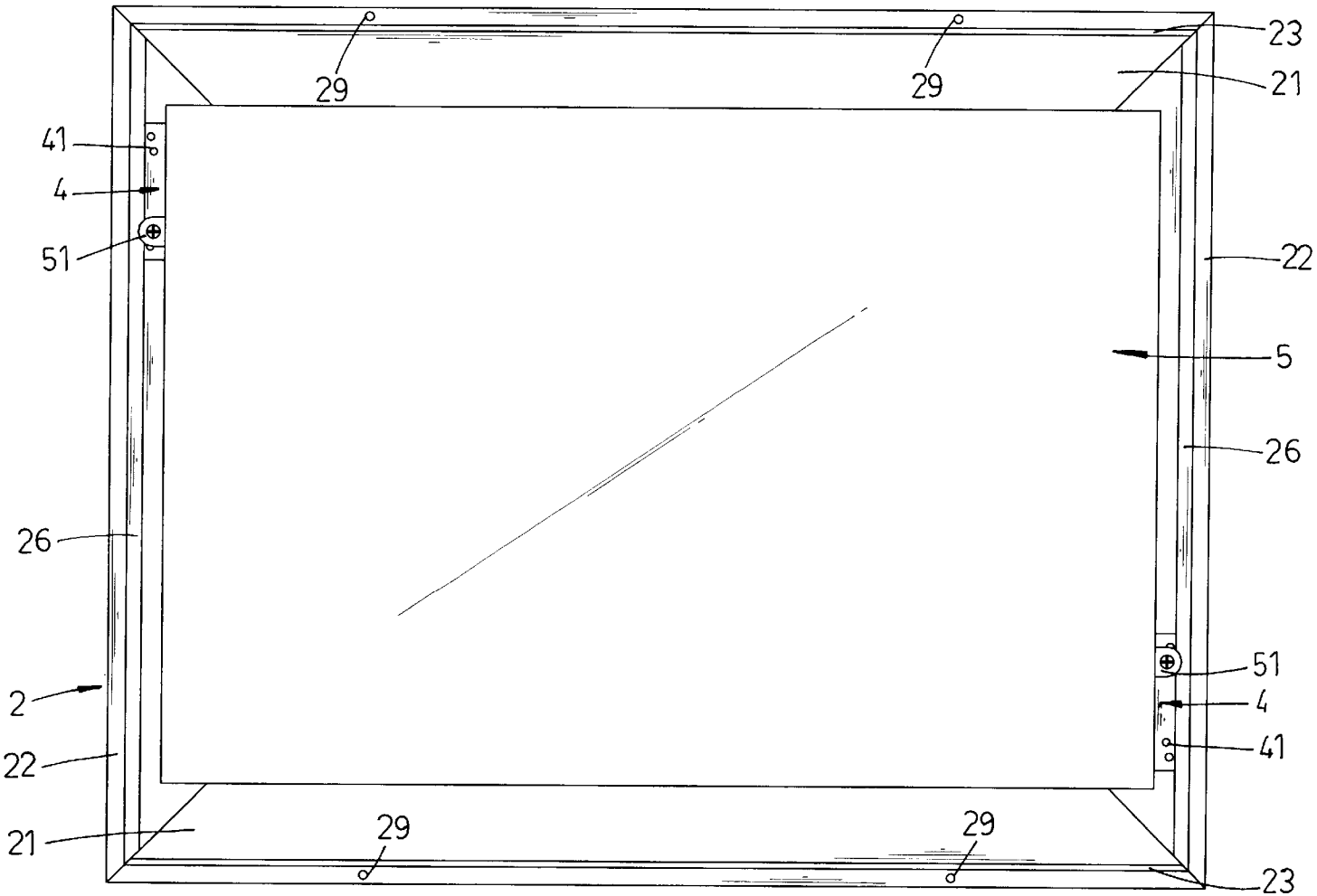
FIG. 8 is a schematic diagram sampling the mobile clamps lock up a small sized LCD panel on the backing pad.

If it is intended to lock an LCD panel 5 of any form onto this standardized backing pad 2 as illustrated in FIG. 7, it is easy to be done by sliding the mobile clamp 4 along the left and right concave tracks 26. Take the left concave track 26 and the mobile clamp 4 as an example for explanation, align the top bolt hole 42 of the mobile clamp 4 with the retaining hole 27 on the tip of the concave track 26, then tighten the hexagon bolt 43 to hold the mobile clamp 4 firmly against the concave track 26 on the backing pad 2. Similarly, move the mobile clamp 4 on the right concave track 26, align the bottom bolt hole 42 with the bottom retaining hole 27, then lock up the mobile clamp 4 on the right concave track 26 of the backing pad 2 by tightening a hexagon bolt 43. For the small-sized LCD panel, the bolt hole 41 and the hexagon bolt 43 shall be selected to fit the lock lug 51 of the LCD panel 5 as shown in FIG. 8.

Figure 9:
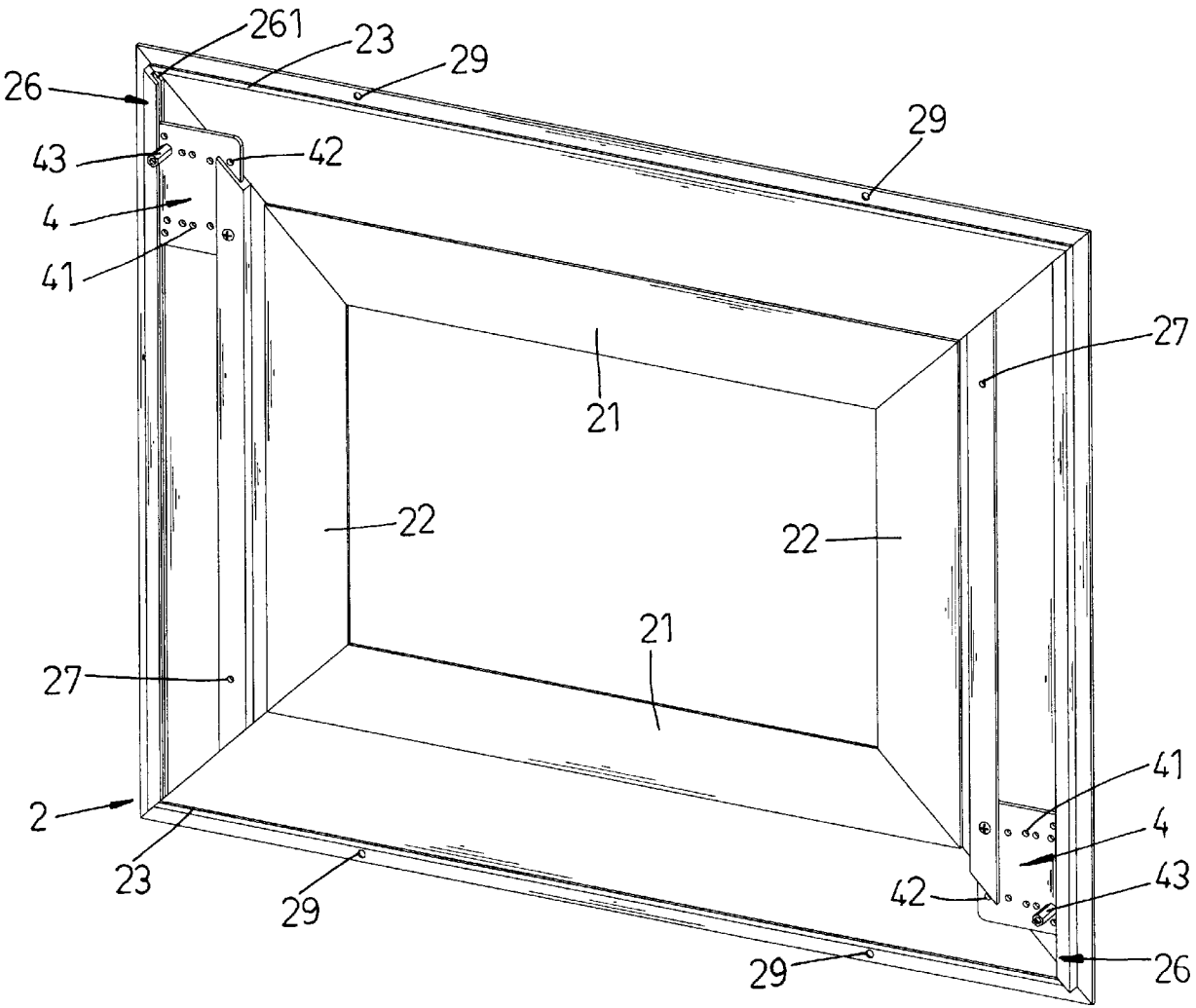
FIG. 9 is a schematic diagram sampling the mobile clamps lock up a large sized LCD panel on the backing pad.
Figure 10:
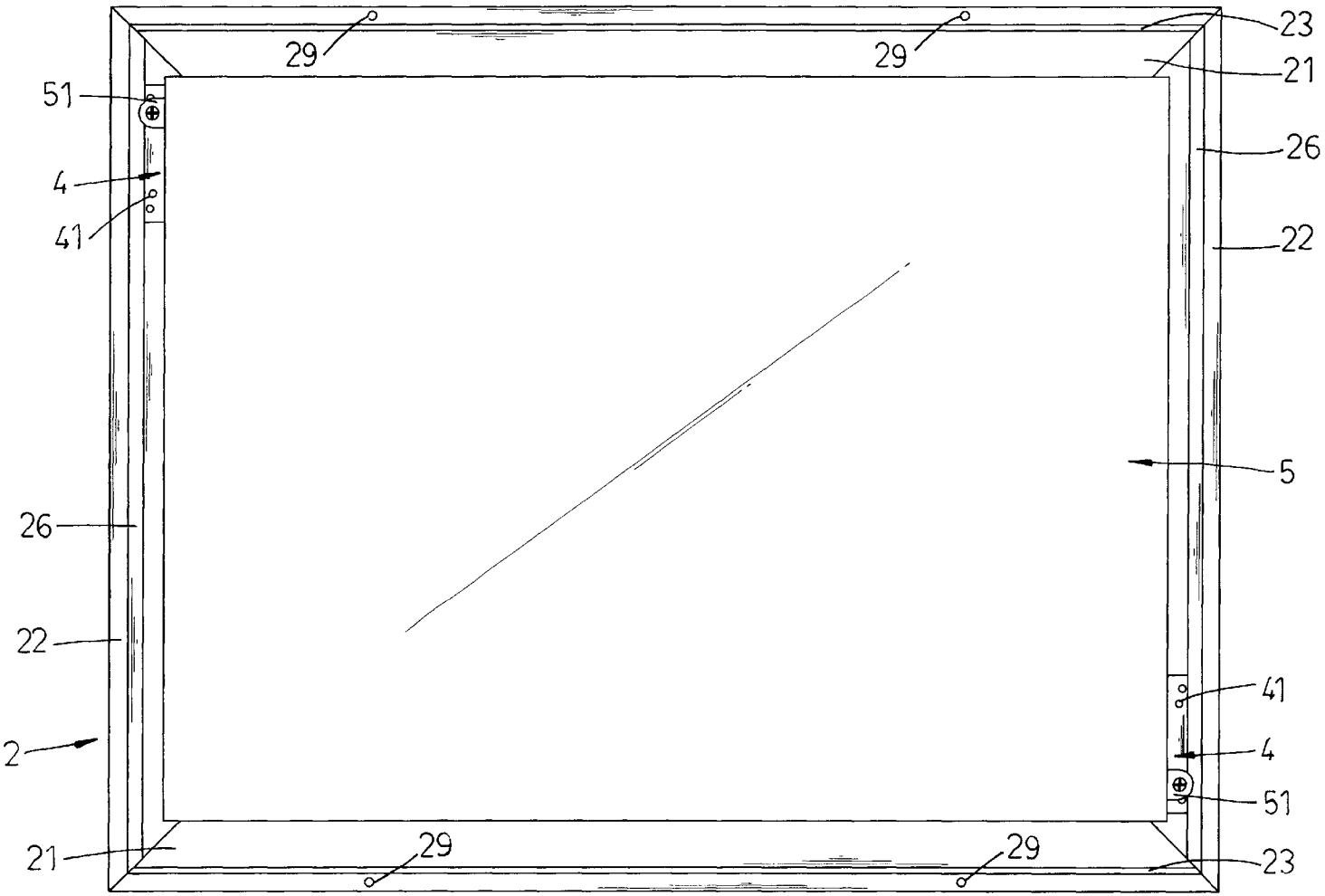
FIG. 10 is an embodiment showing that the mobile clamps on the backing pad lock up a large size LCD panel.

For the large-sized LCD panel, as shown in FIG. 9, loosen the hexagon bolts 43, move the mobile clamp 4 utmost outward on the left and right concave tracks 26 and align the retaining hole 27 with another bolt hole 42 so more internal space is created with the backing pad 2 to contain the large-sized LCD panel. Then select the adequate bolt hole 41 for the appropriate lock lug 51 on the LCD panel, tighten the hexagon bolt 43 to lock up the LCD panel 5 on the backing pad 2 as FIG. 10 shows.

From the above statement, it is clearly understood that the backing pad 2 is standardized and designed with mobile clamps 4 sliding on both the right and left concave tracks 26, which are adaptable to holding the LCD panel in any size. A standardized LCD frame achieves universal application, low product cost and honed competitive edge.

Figure 11:
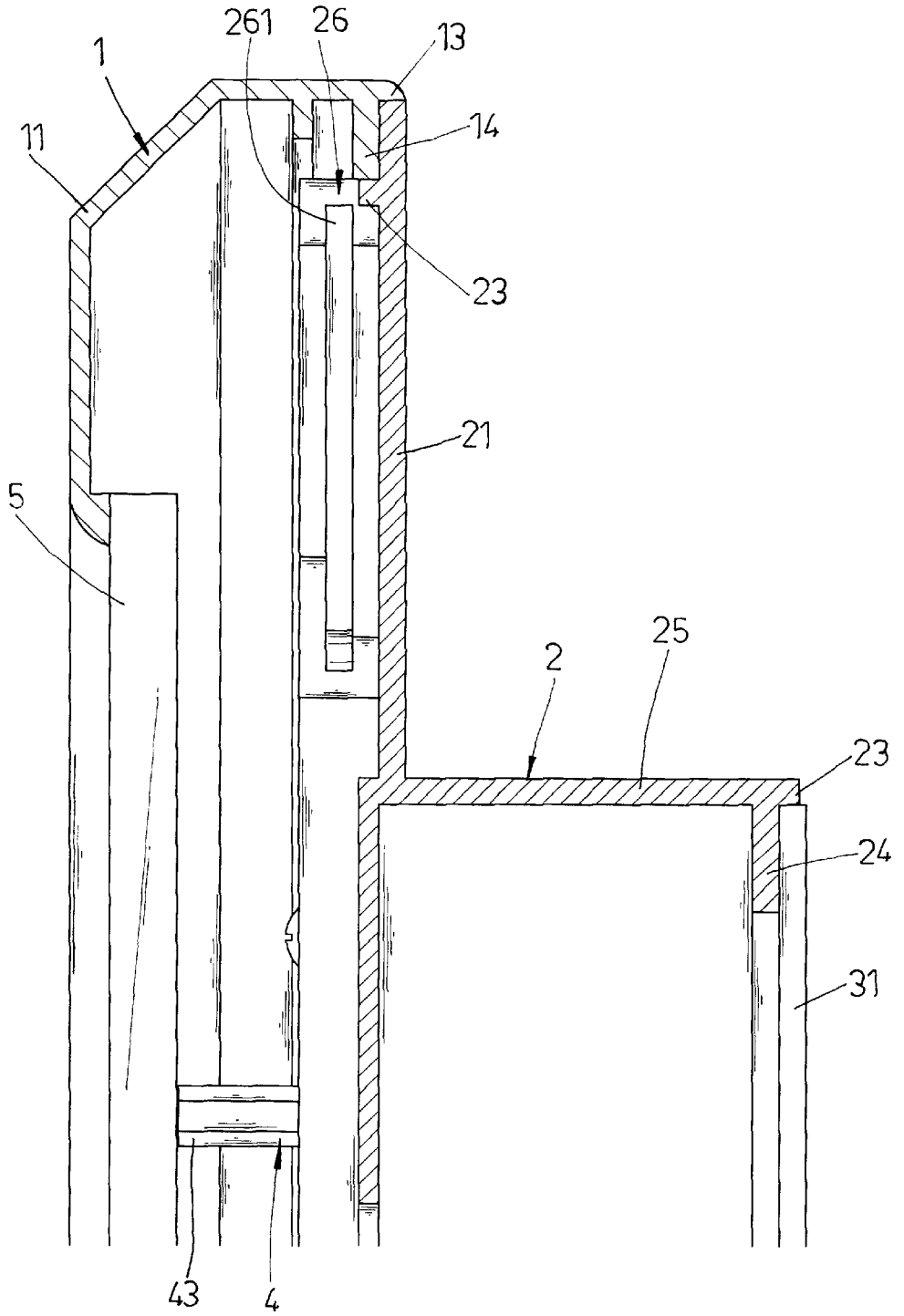
FIG. 11 is a side view of a cross-section of the invention.

As shown in FIG. 11, when the LCD panel 5 is properly mounted on the backing pad 2, place the front molding 1 on the backing pad 2 where the concave rib 23 of the backing pad 2 will fit into the convex groove 14 of the front molding 1. The front molding 1 provides the bolt hole 16, and the backing pad provides the bolt hole 29 in response to the bolt hole 16, and finally a go-through bolt will hold the front molding 1 and the backing pad 2 together and the LCD panel 5 in between. The rectangular concave rib 23 of the backing pad 2 fits the rectangular convex groove 14 of the front molding 1, so the concave ribs 13 and 23 form an insulation shield to ward off the electromagnetic wave, reducing the radioactive effect and gaining better EMI protection. In addition, the convex groove 24 on the vertical strip 25 forms a base foundation to contain the base plate 31 of the support element 3. There provide two bolt holes 29 on the convex groove 14 of the vertical strip 25, and two bolt holes 32 on the base plate 31 are also provided on the position corresponding to that of the bolt holes 29 for holding the base plate 31 to the vertical strip 25 of the backing pad 2. The concave rib 23 on the vertical strip 25 forms another shield to insulate the electromagnetic wave the LCD panel emits. The aluminum-extruded front molding 1, the backing pad 2 and the support element 3 wrap entirely the LCD panel and the concave ribs 13 and 23 and the convex grooves 14 and 24 constitute a safe electromagnetic wave shield for the LCD panel 5. Comparing with the existing plastic LCD frame, it eliminates the metal sheet used as the electromagnetic wave shield and reduces the overall weight to the minimum. It is practicable and progressive.

Figure 12:
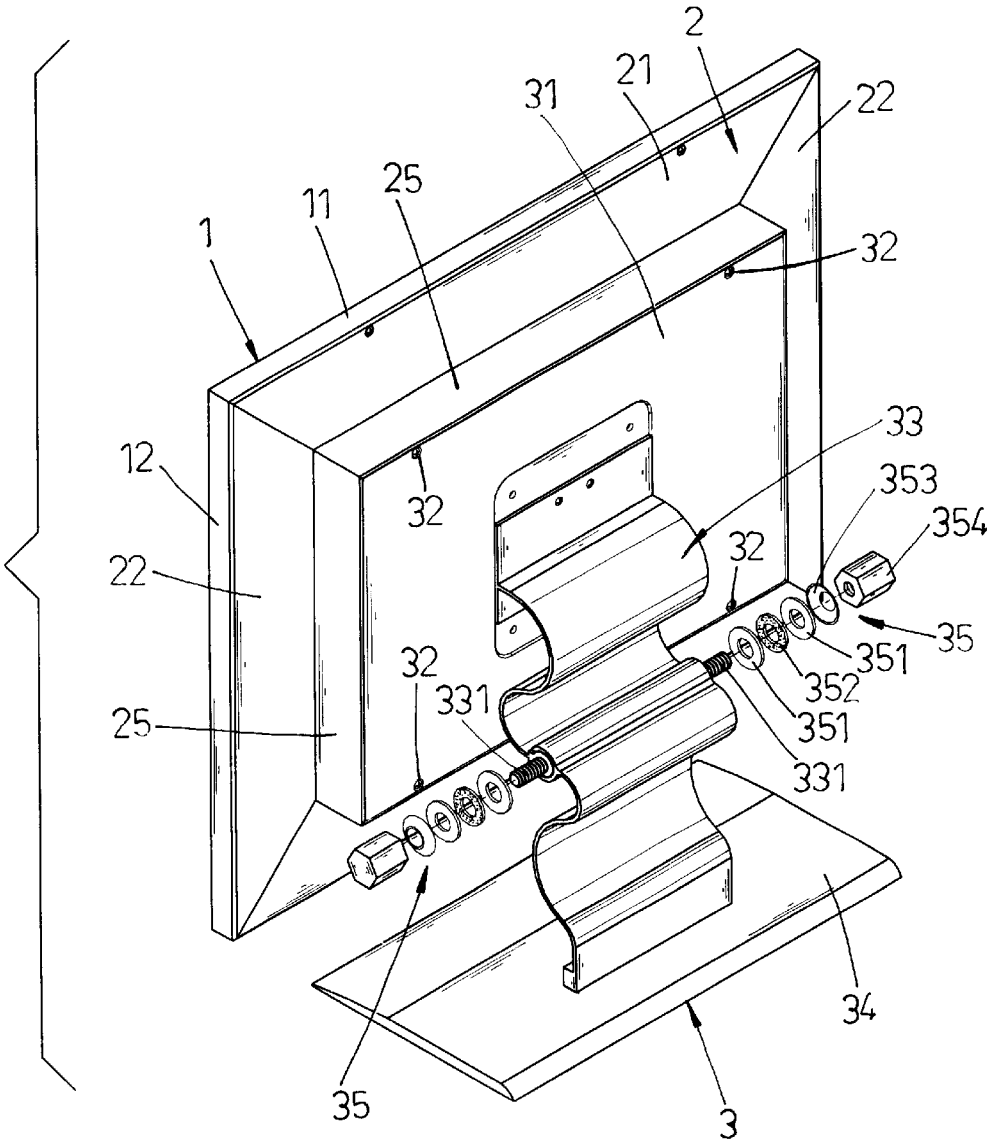
FIG. 12 is a schematic diagram of related support elements of the LCD frame of the invention.

As shown in FIG. 12, the support element 3 constitutes a pivot strip 33 connected to the pivot shaft 331 and fixed on the base plate 34. The pivot shaft 331 comprises a set of adjusting member 35 at each side. The adjusting member 35 is composed of two metal washers 351, and a rubber washer 352 in between, an elastic washer 353 and a nub 354. When the elastic washer 353 is compressed, its conical top will be crushed and tightly compressed on the metal washer 351 to increase the frictional force of metal washer 351 and the rubber washer 352 as well, while the pivot strip 33 is tilted at an angle, it will stay in this posture forever. The base plate 31, the front molding 1, the backing pad and the LCD panel 5 always display at the desired tile position.

What is claimed is:

1. An aluminum-extruded LCD frame for an LCD panel comprising:

a) a backing pad having:

i) two first long stiles, opposing ends of each of the two first long stiles having a forty-five degree cut; and ii) two first short stiles, each of the two first short stiles having a concave track and a slide slot, opposing ends of each of the two first short stiles having a forty-five degree cut, each of the two first long stiles and each of the two first short stiles having a concave rib and a convex groove, each of the two first long stiles welded at opposing ends thereof to opposing ends of one of the two first short stiles to form a first frame;

b) a support element connected to the backing pad;

c) a plurality of mobile clamps, each of the plurality of mobile clamps having a plurality of spaced apart first and second holes, each of the plurality of mobile clamps being inserted into the slide slot of one of the two first short stiles of the backing pad, the LCD panel being connected to one of the plurality of clamps by aligning a selected one of a plurality of lock lugs in the LCD panel with a selected one of the plurality of first holes and inserting a hexagon bolt there through to connect the LCD panel to one of the plurality of clamps; and d) a front molding having:

i) two second long stiles, opposing ends of each of the two second long stiles having a forty-five degree cut; and ii) two second short stiles, opposing ends of each of the two second short stiles having a forty-five degree cut, each of the two second long stiles and each of the two second short stiles having a concave rib and a convex groove, each of the two second long stiles welded at opposing ends thereof to opposing ends of one of the two second short stiles to form a second frame, the second frame being connected to the first frame.

2. The aluminum-extruded LCD frame according to claim 1, wherein each of the two first short stiles of the backing pad includes a plurality of retaining holes in the slide slot, each of the plurality of mobile clamps is adjustably connected to one of the two first short stiles by aligning a selected one of the plurality of second holes with a selected one of the plurality of retaining holes and inserting a bolt there through to connect each of the plurality of mobile clamps to one of the two first short stiles.

3. The aluminum-extruded LCD frame according to claim 1, wherein the concave ribs of the two first long stiles and the two first short stiles of the backing pad are inserted into the convex groove of the two second long stiles and the two second short stiles of the front molding.

4. The aluminum-extruded LCD frame according to claim 1, wherein the support element includes:

a) a pivot strip fixedly connected at a first end thereof to the backing plate;

b) a base plate; and c) a pivot shaft pivotally connecting a second end of the pivot strip to the base plate.

5. The aluminum-extruded LCD frame according to wherein the pivot shaft includes a washer assembly and a nut located on opposing ends thereof, the washer assembly includes a rubber washer with a metal washer located opposing sides thereof and an elastic washer connected between one metal washer and one nut.

* * * * *